US010343864B2

(12) United States Patent
Edmonds et al.

(10) Patent No.: US 10,343,864 B2
(45) **Date of Patent: *Jul. 9, 2019**

(54) PAPER DISPENSER

(71) Applicant: Kohler Co., Kohler, WI (US)

(72) Inventors: Cary D. Edmonds, Plymouth, WI (US); Nicole A. Sorenson, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/810,390

(22) Filed: Nov. 13, 2017

(65) Prior Publication Data

US 2018/0065823 A1 Mar. 8, 2018

Related U.S. Application Data

(63) Continuation of application No. 14/333,399, filed on Jul. 16, 2014, now Pat. No. 9,908,729, which is a (Continued)

(51) Int. Cl.
*B65H 16/06* (2006.01)
*A47K 10/00* (2006.01)
(Continued)

(52) U.S. Cl.
CPC ..... *B65H 16/06* (2013.01); *A47K 10/00* (2013.01); *A47K 10/405* (2013.01); *B65H 16/005* (2013.01); *A47K 2201/02* (2013.01)

(58) Field of Classification Search
CPC ..... B65H 16/06; B65H 16/005; A47K 10/00; A47K 10/405; A47K 10/38; A47K 10/40; A47K 2201/02
See application file for complete search history.

(56) References Cited

U.S. PATENT DOCUMENTS 497,005 A 5/1893 Jerome
810,606 A * 1/1906 Ball ..... A47K 10/38 242/598.2
(Continued)

FOREIGN PATENT DOCUMENTS

DE 20308 300 8/2003

OTHER PUBLICATIONS

International Search Report and Written Opinion for Application No. PCT/US2012/024611, dated Sep. 13, 2012, 9 pages.

*Primary Examiner* — Michael E Gallion
(74) *Attorney, Agent, or Firm* — Foley & Lardner LLP

(57) ABSTRACT

A rolled paper dispenser having a first arm having a cavity; a second, spaced apart, arm that includes one of an extension and a notch; and an elongated paper holder extending between a first end, which is coupled to the first arm, and a second end, which has the other of the extension and the notch to couple to the second arm in a closed position and to decouple from the second arm in an open position, the paper holder comprising a tubular member and a fastener, the tubular member having an outer surface, which is configured to receive a rolled paper product, and an inner surface, which defines a longitudinal bore in which the fastener is disposed, the fastener extending beyond the tubular member at the first end to engage the cavity to couple the paper holder to the first arm.

20 Claims, 11 Drawing Sheets

Related U.S. Application Data continuation of application No. 13/028,938, filed on Feb. 16, 2011, now Pat. No. 8,789,788.

(51) Int. Cl.
*A47K 10/40* (2006.01)
*B65H 16/00* (2006.01)

(56) References Cited

U.S. PATENT DOCUMENTS

| | | | | | |
|---|---|---|---|---|---|
| 873,188 | A | | 12/1907 | Thumann | |
| 1,069,757 | A | | 8/1913 | Bens et al. | |
| 1,182,523 | A | | 5/1916 | Benson | |
| 1,665,738 | A | * | 4/1928 | Hoegger | A47K 10/22 242/598.2 |
| 1,665,739 | A | * | 4/1928 | Hoegger | A47K 10/40 101/216 |
| 1,778,856 | A | * | 10/1930 | Hoegger | A47K 10/22 242/565 |
| 1,889,024 | A | * | 11/1932 | Marsh | A47K 10/38 242/598.1 |
| 2,466,957 | A | | 4/1949 | Lewis | |
| 2,517,809 | A | | 8/1950 | Tarzian | |
| 3,022,957 | A | | 2/1962 | Blunt et al. | |
| 3,138,340 | A | | 6/1964 | Caravella | |
| 3,157,370 | A | | 11/1964 | Govatsos et al. | |
| 3,295,777 | A | | 1/1967 | Carroll | |
| 3,586,252 | A | | 6/1971 | Sutton | |
| D259,906 | S | | 7/1981 | Fleischmann et al. | |
| 4,295,921 | A | * | 10/1981 | Bopst, III | B44C 7/06 156/577 |
| 4,381,083 | A | | 4/1983 | Tsunetsugu | |
| 4,416,425 | A | | 11/1983 | Kish | |
| 4,741,486 | A | | 5/1988 | Ancona et al. | |
| 4,775,109 | A | | 10/1988 | Tegg | |
| 4,824,038 | A | | 4/1989 | Chandler | |
| 4,836,462 | A | | 6/1989 | Bruss | |
| 4,871,123 | A | | 10/1989 | Lee | |
| D317,386 | S | | 6/1991 | Mckeone | |
| 5,149,003 | A | | 9/1992 | Tharp | |
| 5,222,678 | A | | 6/1993 | Carrington | |
| 5,450,981 | A | | 9/1995 | Fields | |
| 5,669,576 | A | | 9/1997 | Moody | |
| 5,718,396 | A | * | 2/1998 | Maresca | A47K 10/38 242/598.2 |
| 5,765,775 | A | | 6/1998 | Keserica | |
| 5,782,428 | A | * | 7/1998 | Chabot | A47K 10/38 242/596.3 |
| 5,868,344 | A | | 2/1999 | Melnich | |
| 5,871,170 | A | * | 2/1999 | Morales | A47K 10/40 242/592 |
| 5,913,491 | A | | 6/1999 | Bulla | |
| 6,007,019 | A | | 12/1999 | Lynch | |
| 6,199,791 | B1 | | 3/2001 | Conran et al. | |
| D450,962 | S | | 11/2001 | Hundley | |
| 6,328,253 | B1 | * | 12/2001 | Paul | A47K 10/40 242/596.3 |
| D521,288 | S | | 5/2006 | Barry | |
| D534,023 | S | | 12/2006 | Berberet et al. | |
| 7,290,733 | B2 | | 11/2007 | Kamenstein | |
| 7,367,524 | B2 | | 5/2008 | Burnett | |
| D573,821 | S | | 7/2008 | Rubin et al. | |
| 7,762,493 | B2 | * | 7/2010 | Berberet | A47K 10/405 242/598.2 |
| 8,789,788 | B2 | * | 7/2014 | Edmonds | A47K 10/00 242/598.2 |
| 9,908,729 | B2 | * | 3/2018 | Edmonds | A47K 10/00 |
| 2002/0020780 | A1 | * | 2/2002 | Otsuji | A47K 10/40 242/598.2 |
| 2006/0261211 | A1 | * | 11/2006 | Hass | A47K 10/405 242/598.1 |
| 2007/0158491 | A1 | | 7/2007 | Moore | |
| 2007/0267534 | A1 | * | 11/2007 | Burnett | A47K 10/405 242/598.2 |
| 2009/0242713 | A1 | * | 10/2009 | Lowe | A47K 10/10 248/222.13 |
| 2015/0028149 | A1 | * | 1/2015 | Szymaszek | B60R 7/08 242/598 |

* cited by examiner

PAPER DISPENSER

CROSS-REFERENCE TO RELATED PATENT APPLICATIONS

This application is a Continuation of U.S. patent application Ser. No. 14/333,399 filed on Jul. 16, 2014, which is a Continuation of U.S. patent application Ser. No. 13/028,938 filed on Feb. 16, 2011 and issued as U.S. Pat. No. 8,789,788 on Jul. 29, 2014. The entire disclosures of the aforementioned U.S. applications are incorporated by reference herein in their entireties.

BACKGROUND

The present disclosure relates generally to the field of paper dispensers. More particularly, the present disclosure relates to dispensers for rolled paper products, such as toilet paper, paper towels, and other rolled paper products.

Conventional dispensers for rolled paper products, such as toilet paper or paper towels, typically have a sprung bar extending and compressed between two members extending from a mounting surface. A roll of product is placed onto the sprung bar and held in place to allow product to be dispensed. To remove an empty roll or receive a new roll or product, the sprung bar is compressed to a length less than the distance between the two members, such that the sprung bar may be removed from the two members.

It would be advantageous to provide an improved dispenser that may allow rolls of paper products to be changed in an easier manner.

SUMMARY

According to an exemplary embodiment, a dispenser for a rolled paper product includes a first arm comprising an elongate member configured to receive a roll of product and a first mounting bracket configured to rotatingly couple the first arm to a mounting surface. The dispenser also includes a second arm and a second mounting bracket configured to rigidly couple the second arm to the mounting surface. The first arm is configured to cover the first mounting bracket from view.

According to another exemplary embodiment, a paper dispenser includes a first arm comprising a base portion and an elongate member comprising a first end rigidly coupled to the first arm and a second end comprising an engaging surface. The dispenser also includes a second arm comprising a base portion and an end portion comprising an extension. The first arm is configured to rotate in a plane generally parallel to a mounting surface such that the engaging surface of the elongate member engages the extension of the second arm, and wherein the engaging surface and post are configured to prevent translational movement between the extension member and second arm.

According to another exemplary embodiment, a paper dispenser includes a first arm coupled to an elongate member and a first mounting bracket configured to rotatingly couple the first arm to a mounting surface. The paper dispenser also includes a second arm and a second mounting bracket configured to rigidly couple the second arm to the mounting surface. The first arm and first mounting bracket are configured to limit rotation of the first arm to a predetermined angular range.

DETAILED DESCRIPTION

Figure 1A:
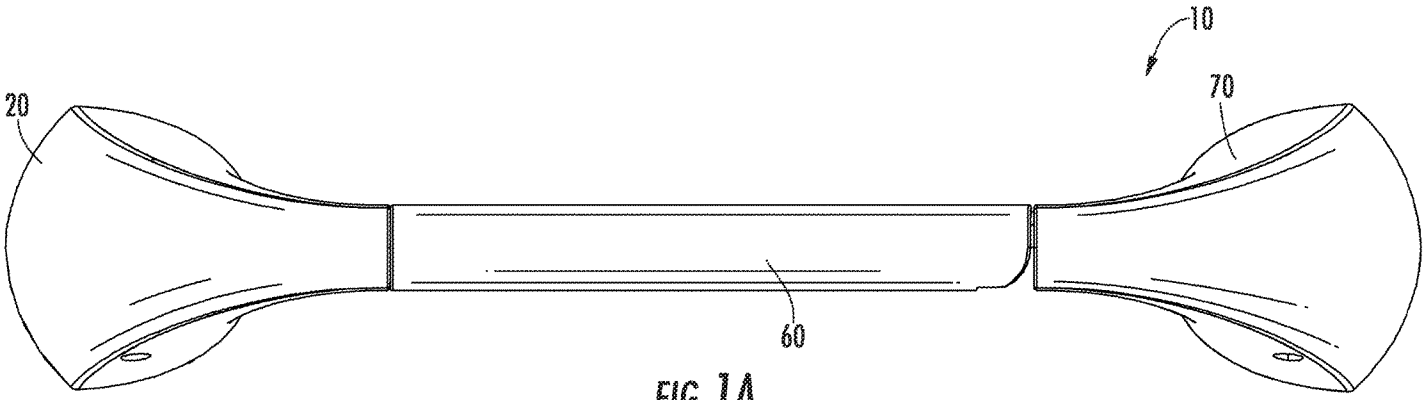
FIG. 1A is a front view of a paper dispenser in a closed position according to an exemplary embodiment.
Figure 1B:
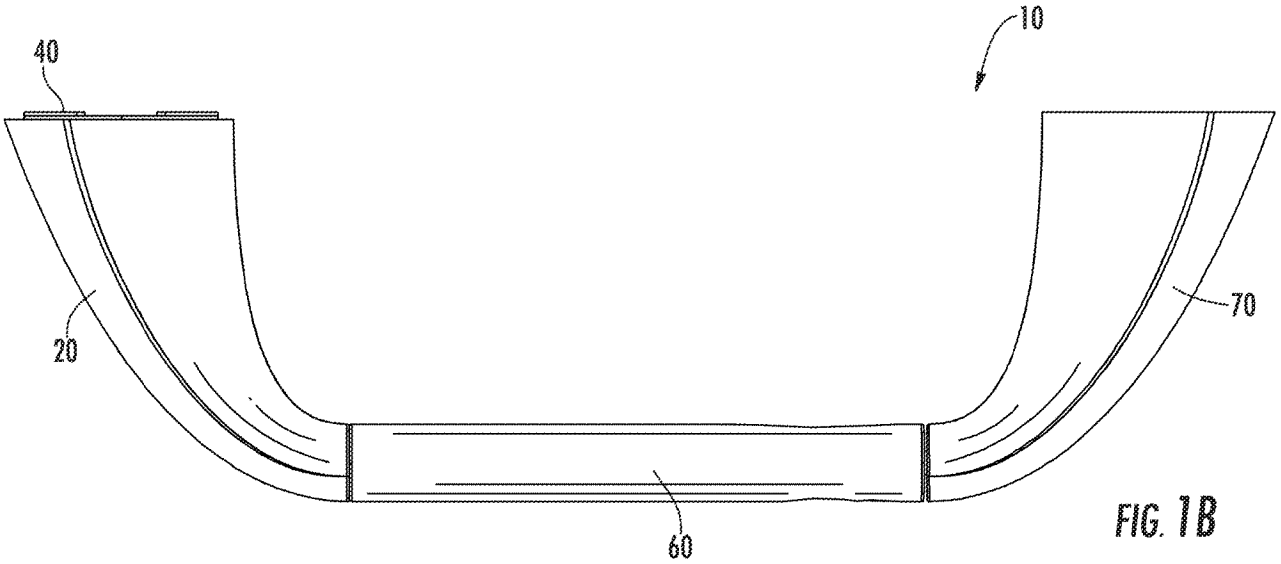
FIG. 1B is a top view of a paper dispenser in a closed position according to an exemplary embodiment.
Figure 1C:
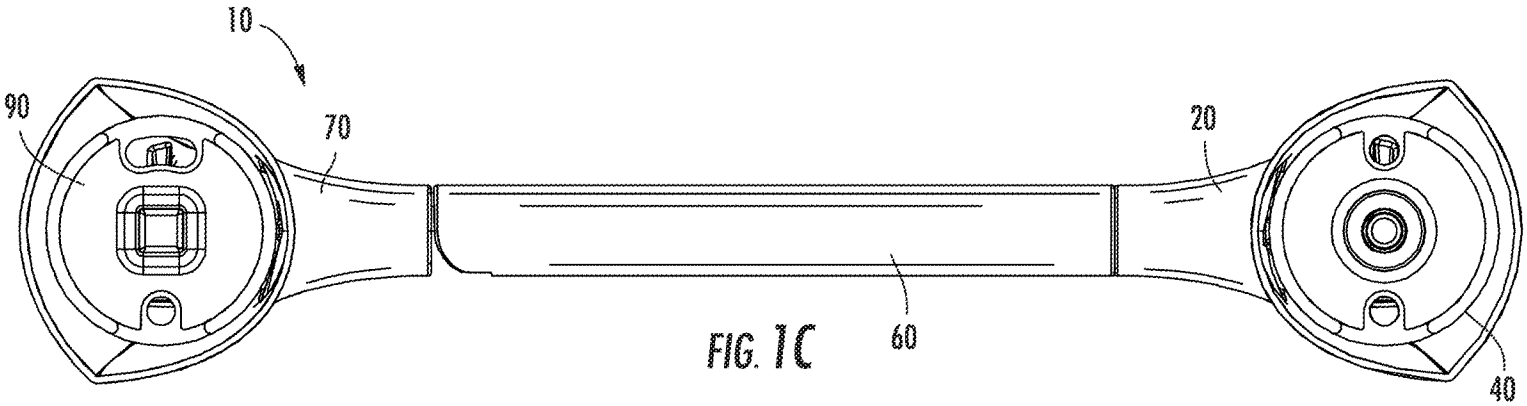
FIG. 1C is a rear view of a paper dispenser in a closed position according to an exemplary embodiment.
Figure 1D:
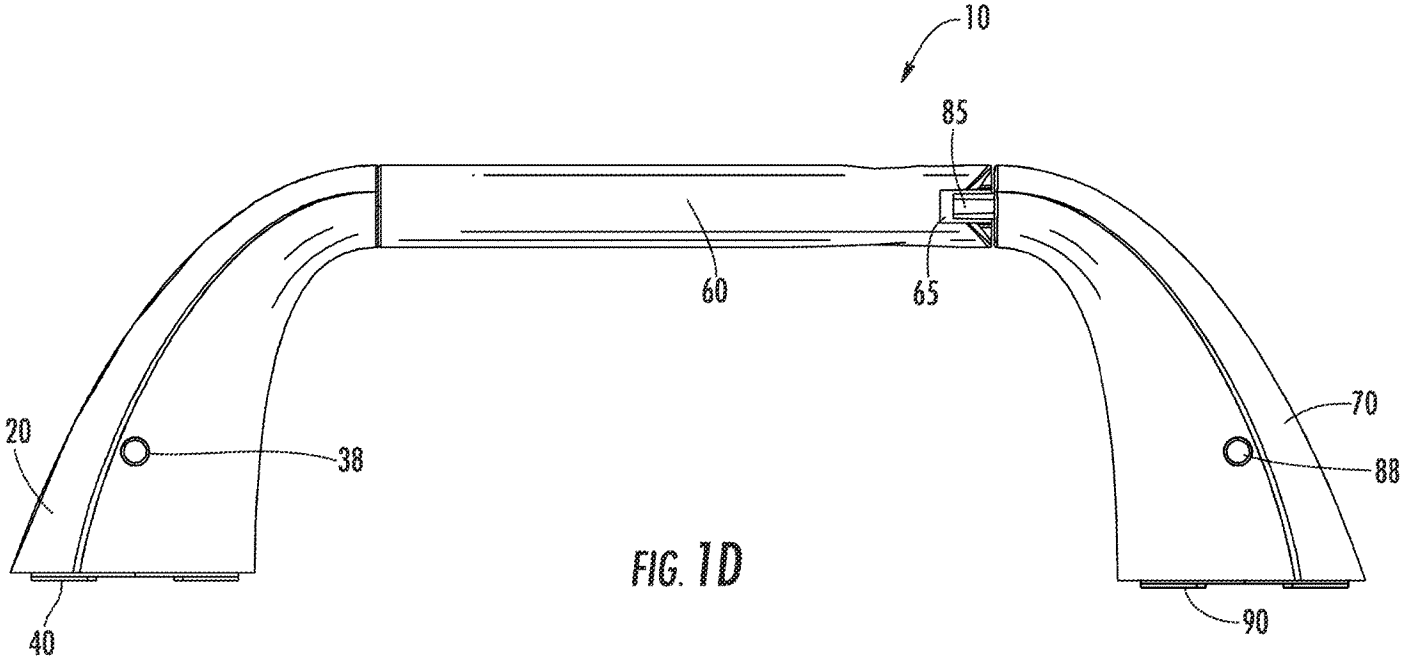
FIG. 1D is a bottom view of a paper dispenser in a closed position according to an exemplary embodiment.
Figure 2:
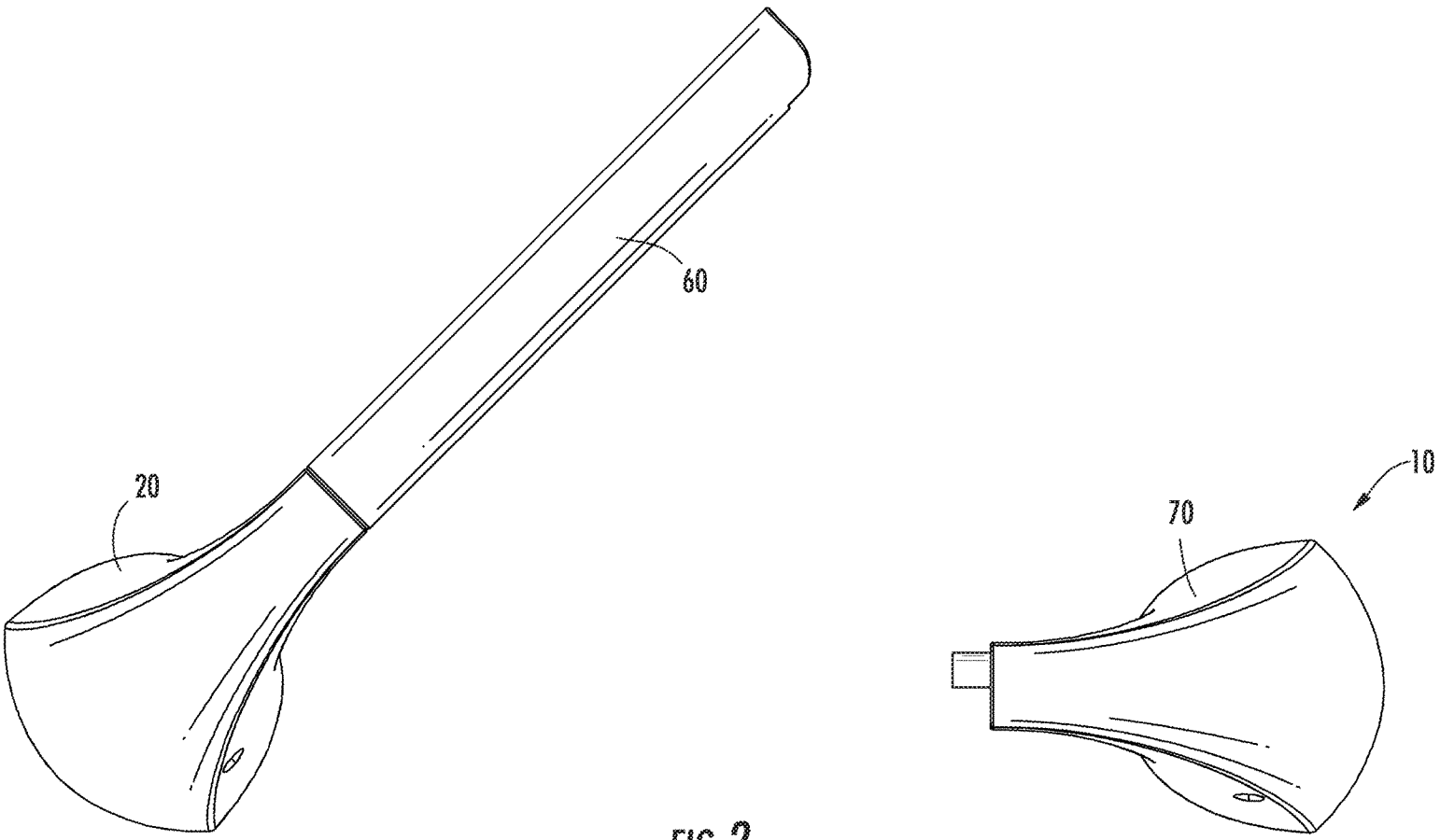
FIG. 2 is a front view of a paper dispenser in an open position according to an exemplary embodiment.

According to an exemplary embodiment, a dispenser for rolled paper product includes a first arm and a second arm, with the first arm having an elongate member configured to receive a roll of paper product. A first mounting bracket is configured to rotatingly couple the first arm to a mounting surface. The first arm is configured to cover the first mounting bracket from view. A second mounting bracket is configured to rigidly couple the second arm to the mounting surface.

According to an exemplary embodiment, a paper dispenser includes a first arm, elongate member, and second arm. The first arm includes a base portion. The elongate member includes a first end that is rigidly coupled to the first arm and a second end having an engaging surface. The second arm includes a base portion and an end portion having an extension. The first arm is configured to rotate in a plane generally parallel to the mounting surface such that the engaging surface of the elongate member engages the extension of the second arm. The engaging surface and the post are configured to prevent translational movement between the extension member and the second arm.

According to an exemplary embodiment, a paper dispenser includes a first arm, a first mounting bracket, a second arm, a second mounting bracket, and an elongate member. The first arm is coupled to the elongate member. The first mounting bracket is configured to rotatingly couple the first arm to a mounting surface. The first arm and the first mounting bracket are configured to limit rotation of the first arm to a predetermined angular range.

Referring to FIGS. 1A-1D and 2, according to an exemplary embodiment, a paper dispenser 10 generally includes a first arm 20, an extension member 60 rigidly coupled to the first arm, and a second arm 70. The first and second arms 20, 70 are configured to be coupled to and extend from a generally mounting surface, such as a vertical wall, cabinet base, or door. In a closed position (see FIG. 1A), the paper dispenser 10 is configured to hold and retain a roll of paper product. More particularly, the extension member 60 is arranged between the first and second arms 20, 70 and is releasably engaged with the second arm. In an open position (see FIG. 2), the paper dispenser 10 is configured to receive a new roll of paper product or have removed an empty roll. More particularly, in the open position, the first arm 20 is rotated about a generally perpendicular axis to the surface, such that the extension member 60 is not engaged with the second arm 70.

Figure 3A:
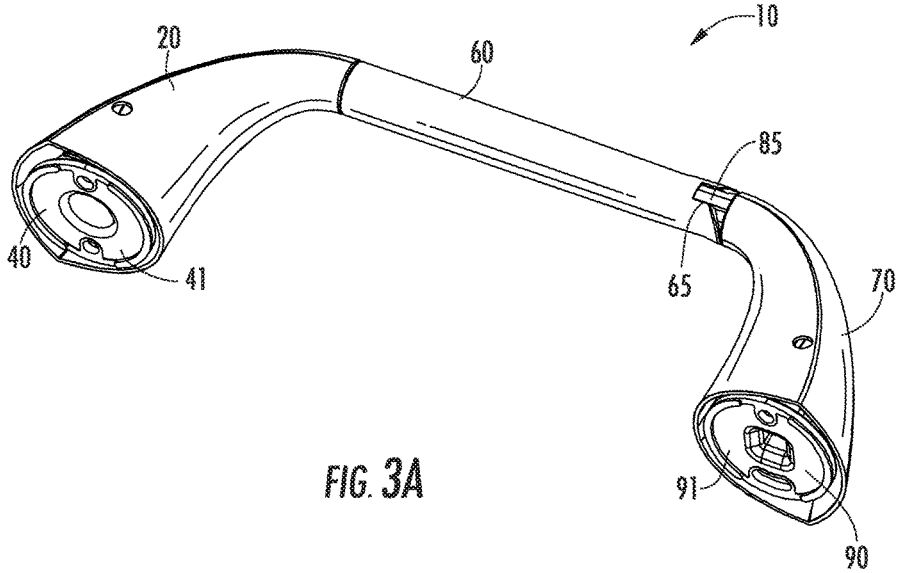
FIG. 3A is a perspective
Figure 3B:
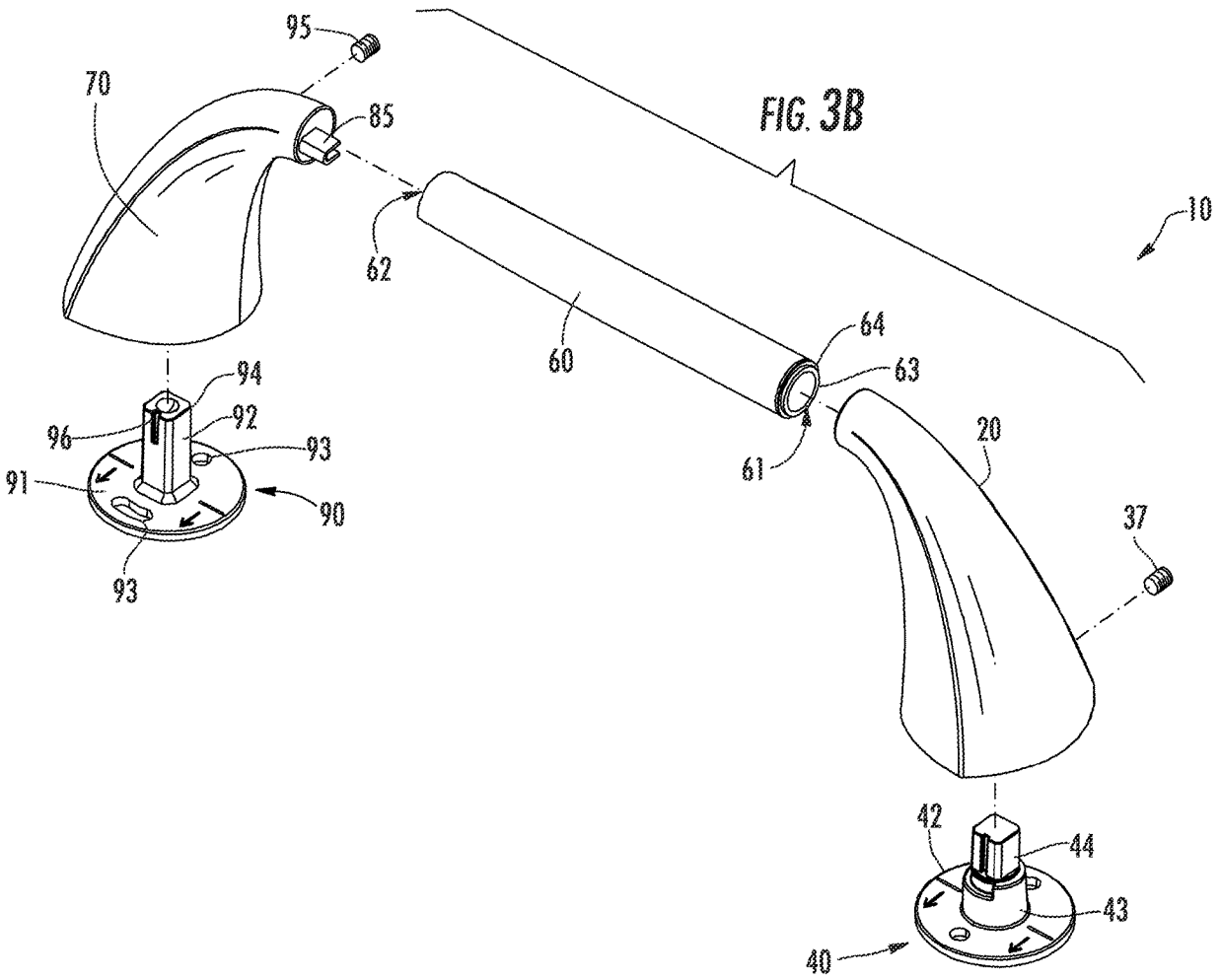
FIG. 3B is an exploded perspective view of a paper dispenser according to an exemplary embodiment.
Figure 4:
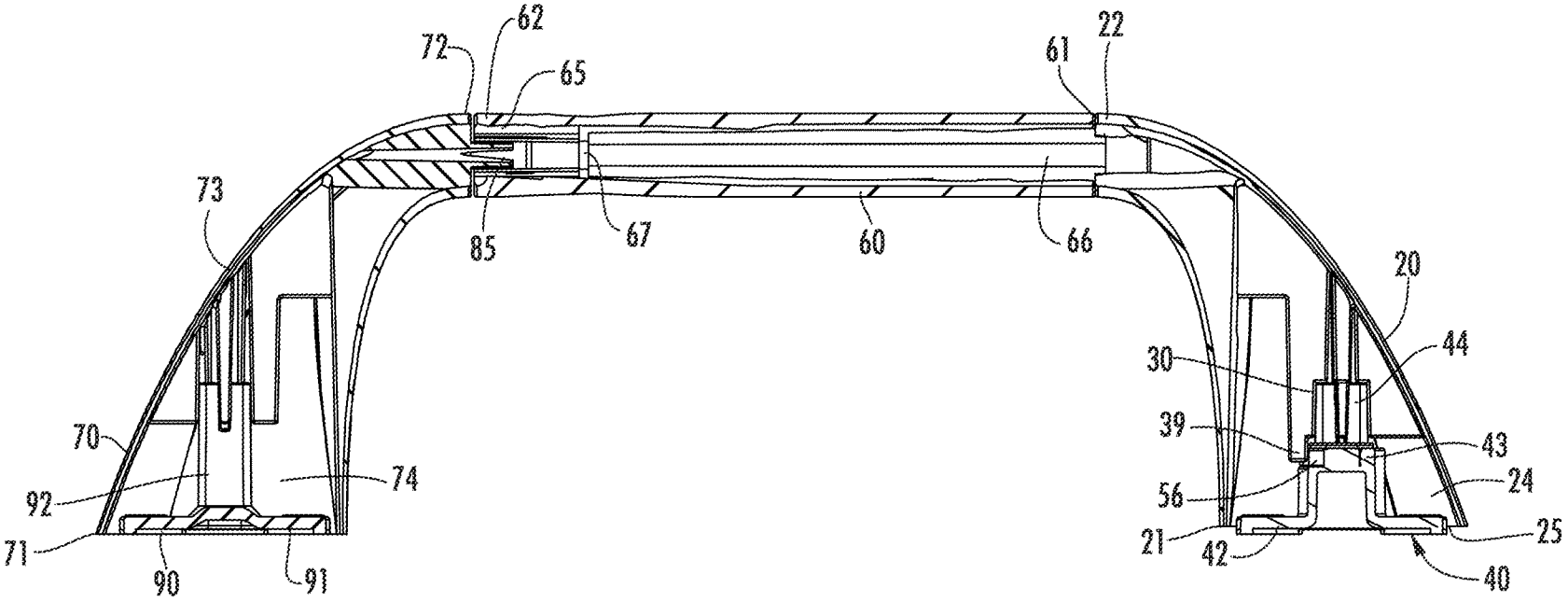
FIG. 4 is a cross-sectional view of a paper dispenser according to an exemplary embodiment.

Now referring to FIGS. 3A, 3B, and 4, according to an exemplary embodiment, the paper dispenser 10 includes a first arm 20 and a corresponding rotating mounting bracket 40, a second arm 70 and a corresponding stationary mounting bracket 90, and an extension member 60 extending from the first arm 20. As discussed below, the rotating and stationary mounting brackets 40, 90 are configured to couple the first and second arms 20, 70, respectively, to a mounting surface. More particularly, the rotating mounting bracket 40 provides a rotating coupling for the first arm 20 to mount to the mounting surface, and the stationary mounting bracket 90 provides a stationary coupling for the second arm 70 to mount to the mounting surface.

According to an exemplary embodiment, the first arm 20, extension member 60, and second arm 70 are matching cast brass pieces with a chrome finish. According to other exemplary embodiments, the first arm 20, extension member 60, and second arm 70 are not matching, are made from different materials (e.g., aluminum, zinc, alloys, composites, plastic, etc.), are manufactured according to different methods (e.g., machining, molding, etc.), and/or may have different finishes (e.g., bronze, brushed, satin, painted, etc.).

According to an exemplary embodiment, the rotating and stationary mounting brackets 40, 90 are cast aluminum. According to other exemplary embodiments, the rotating and stationary mounting brackets 40, 90 may be made from different materials (e.g., brass, zinc, allows, composites, plastic, etc.) and/or may be manufactured according to different methods (e.g., machining, molding, etc.). Further, the rotating and stationary mounting brackets 40, 90 may include other components made from other materials.

Figure 5A:
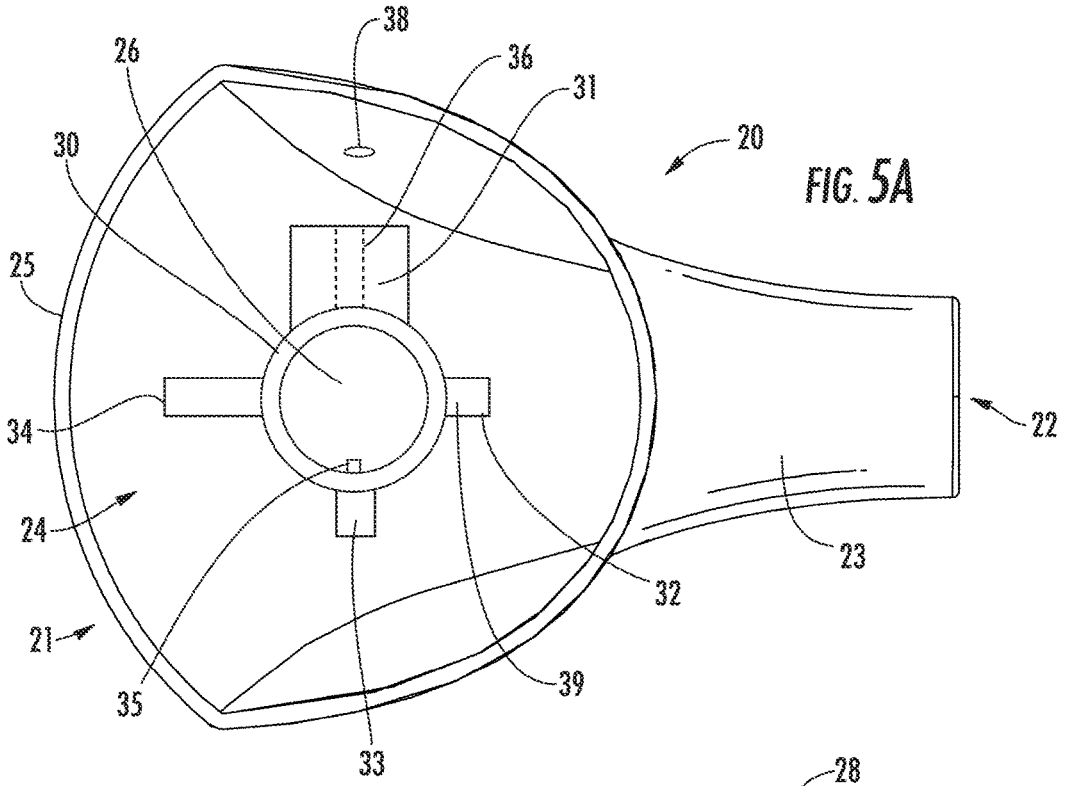
FIG. 5A is a rear view of a first arm of a paper dispenser according to an exemplary embodiment.
Figure 5B:
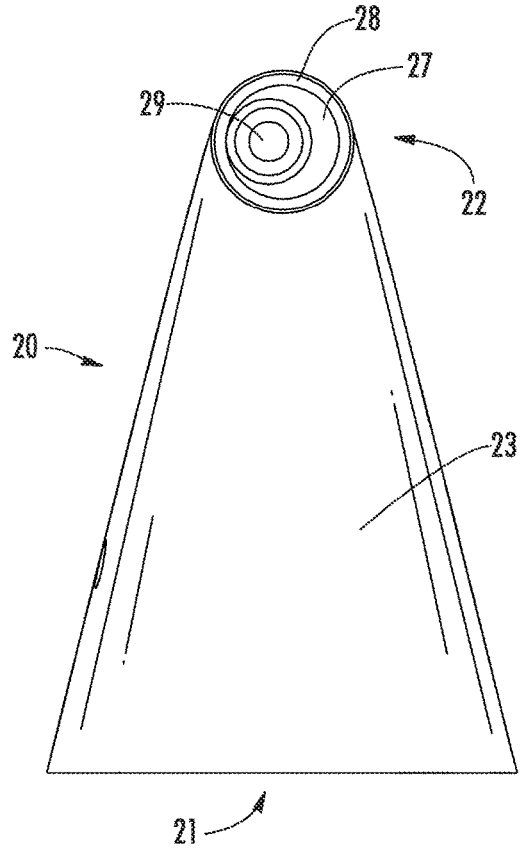
FIG. 5B is a side view of the first arm shown in FIG. 5A according to an exemplary embodiment.

Now referring to FIG. 5A-5B, according to an exemplary embodiment, the first arm 20 generally includes a base portion 21, an end portion 22, and a body portion 23 extending between the base portion 21 and end portion 22. The base portion 21 includes a cavity 24 generally defined by a base peripheral edge 25 and an interior surface of the body portion 23. The cavity 24 includes a receptacle 26 integrally or separately formed from the first arm 20. As discussed in further detail below, the first arm 20 is configured to couple to the rotating mounting bracket 40 by way of the receptacle 26 receiving a rotating post or extension 44 of the rotating mounting bracket 40. Accordingly, various features of the first arm 20 and receptacle 26 are discussed in conjunction with the rotating mounting bracket 40 below.

According to an exemplary embodiment, similar to the base portion 21, the end portion 22 includes a cavity 27, which may or may not be continuous with cavity 24 of the base portion 21. The cavity 27 is defined by an interior surface of the body portion 23 and a peripheral edge 28. A fastening aperture 29 is disposed within the cavity 27 and is coupled to or integrally formed with the first arm 20. As discussed in further detail below, the first arm 20 is configured to rigidly couple to the extension member 60 at the end portion 22. Various features of the first arm 20 and the end portion 22 are discussed in conjunction with the extension member 60.

Figure 6A:
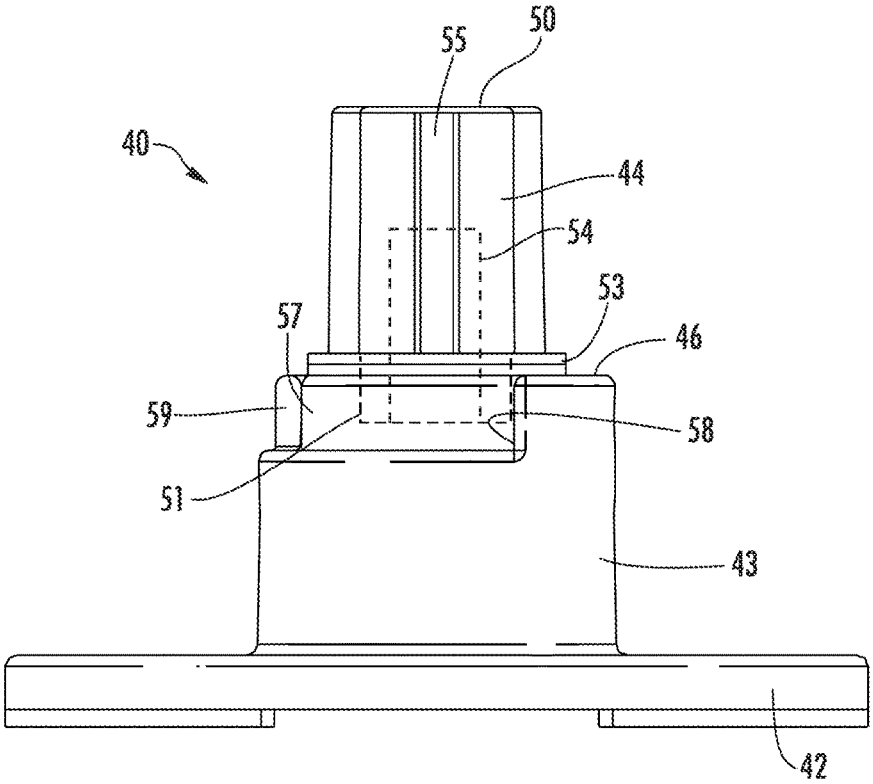
FIG. 6A is a perspective view of a rotating bracket of a paper dispenser according to an exemplary embodiment.
Figure 6B:
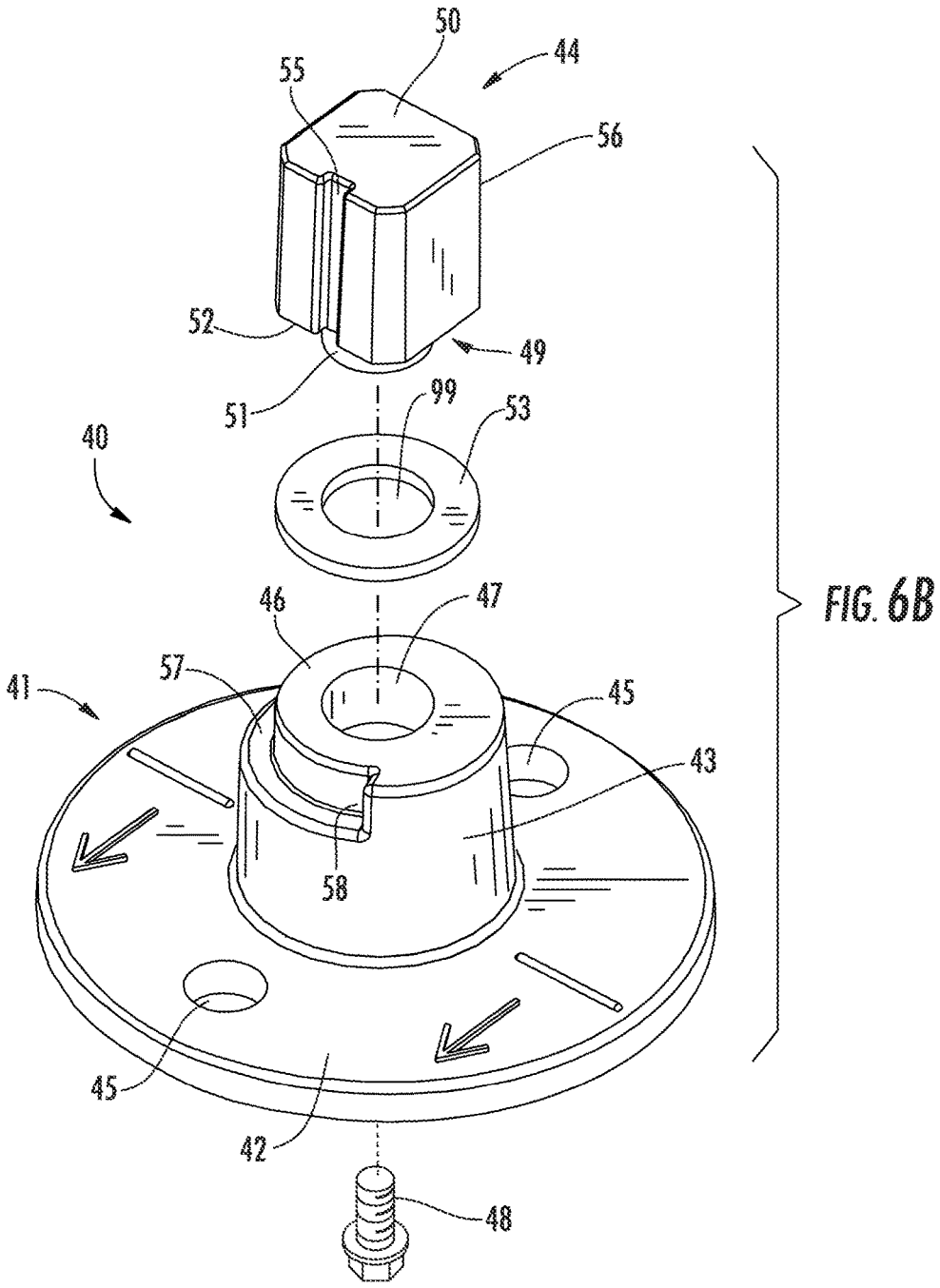
FIG. 6B is an exploded perspective view of the rotating bracket shown in FIG. 6A according to an exemplary embodiment.

Now referring to FIG. 6A-6B, according to an exemplary embodiment, the rotating mounting bracket 40 generally includes a base 41 configured to mount to the mounting surface and a rotating post 44 configured to rotate relative to the base 41. The base 41 includes a base flange 42 and a base post 43. The base flange 42 is configured to be coupled to the mounting surface and includes one or more apertures 45 configured to receive fasteners (e.g., screws, bolts, clips, pins, etc.) for coupling the base flange 42 to the mounting surface.

According to an exemplary embodiment, the base post 43 is configured to provide a surface against which the rotating post 44 may rotate. The base post 43 is a generally hollow cylindrical or conical member. The base post 43 extends away from the base flange 42 from a concentric location at generally a perpendicular angle and terminates at a post flange 46 (e.g., a flat surface generally parallel with the base flange 42). An aperture 47 is concentrically located on the post flange 46 and is configured to receive a fastener 48 for coupling the rotating post 44 to the base post 43. The aperture 47 may also be configured to receive a portion of the rotating post 44.

According to an exemplary embodiment, the rotating post 44 is configured to be rotatingly coupled to the base post 43 of the rotating mounting bracket 40. The rotating post 44 is a generally elongate member (e.g., squared-off cylindrical, cylindrical, rectangular, conical, etc.) that terminates at first and second ends 49, 50. The first end 49 of the rotating post 44 is configured to be disposed proximate the post flange 46 of the base post 43. The first end 49 includes a shoulder portion 52 configured to abut the post flange 46 or a bushing 53 disposed therebetween. The first end 49 also includes an extension 51 configured to be disposed in the aperture 47 of the base post 43 to maintain concentric alignment of the base post 43 relative to the rotating post 44 (e.g., a cylindrical or partial-conical extension having tight tolerance to the aperture 47 of the base post 43). The first end 49 also includes an aperture 54 configured to receive and couple to the fastener 48, such as via threads. According to other exemplary embodiments, the rotating post 44 may be configured in other manners including, for example, providing no extension 51, with the rotating post 44 instead being held in alignment by the fastener 48 that is configured to abut the aperture 47 of the base post 43.

According to an exemplary embodiment, the rotating mounting bracket 40 includes a bushing 53. The bushing 53 is configured to provide one or more surfaces against which the post flange 46 of the base post 43 and/or the shoulder 52 of the rotating post 44 may slide. The bushing 53 includes a central aperture 99 for receiving the fastener 48 therethrough.

According to an exemplary embodiment, the base post 43, rotating post 44, fastener 48, and bushing 53 are collectively configured to control the torque required to rotate the rotating post 44 (i.e., and the first arm 20) relative to the base post 43 (i.e., and the mounting surface). A desired torque required to move the rotating post 44 may, for example, require a desired amount of force be applied to the first arm 20 and extension member 60 to move between open and close positions. The required input torque may, for example, be controlled by configuring the base post 43 and rotating post 44 (e.g., providing different surface finishes or surface areas to the post flange 46 and/or the shoulder 52, etc.), configuring the bushing 53 (e.g., material selection, surface finish on either side, thickness, etc.), and the compression between the post flange 46 of the base post 43 and the shoulder 52 of the rotating post 44 (e.g., tightening a threaded fastener 48 to a specified torque, specifying a distance between the post flange 46 of the base post 43 and the shoulder 52 of the rotating post 44, etc.). The fastener 48 may be held in position relative to the rotating post 44 to fix the compression and torque required for motion between the rotating post 44 and the base post 43 by, for example, using an adhesive, providing an abutting surface within the aperture 54, and/or providing tight tolerance between the aperture 54 and the fastener 48.

Referring now to FIGS. 4, 5A-5B, and 6A-6B, according to an exemplary embodiment, corresponding features of the receptacle 26 and rotating post 44 are configured to rigidly couple the first arm 20 to the rotating mounting bracket 40 and limit rotational movement of the first arm 20 relative to the mounting surface. Further, the first arm 20 is configured to generally cover the rotating mounting bracket 40 from view.

According to an exemplary embodiment, the first arm 20 is configured to rigidly couple to the rotating mounting bracket 40 through various complementary features of the first arm 20 and the rotating mounting bracket 40. For example, the receptacle 26 and rotating post 44 include, respectively, corresponding interior and exterior shapes, a tab and slot, and an aperture and mating surface for receiving a fastener.

According to an exemplary embodiment, the receptacle 26 and rotating post 44 are configured to allow the receptacle 26 to receive the rotating post 44. The receptacle 26 is generally defined by an exterior wall 30 having four supports 31, 32, 33, 34 extending between the wall 30 and the interior portion of the body 23 of the first arm 20. The receptacle 26 and rotating post 44 are shaped and sized in a complementary manner, such that the rotating post 44 may be disposed generally inside the receptacle 26 with relatively tight tolerance (e.g., generally cylindrical cross-sectional shapes and less than approximately 1 mm). The receptacle 26 and/or the rotating post 44 may also be tapered for easy assembly and/or alignment (e.g., the receptacle 26 being wider at its opening, and the rotating post 44 being narrower at its second end 50 compared to its first end 49). According to other exemplary embodiments, the receptacle 26 and rotating post 44 may be configured in other contemplated manners including, for example, by providing different shapes (e.g., round, polygonal, square, rectangular, conical or otherwise tapered, whether the same or different for the receptacle 26 and rotating post 44), by providing lesser or greater tolerance (e.g., approximately 0.2 mm, 0.5 mm, 2 mm, etc.), and/or by providing the receptacle 26 in different manners (e.g., no exterior wall and only separate surfaces, more or fewer supports, integral with or separate and coupled to the first arm 20).

According to an exemplary embodiment, the receptacle 26 includes a tab 35 that is complementary to a slot 55 of the rotating post 44 configured to receive the tab 35. The tab 35 and slot 55 may be configured to ensure proper alignment between the receptacle 26 and the rotating post 44 and/or to prevent relative rotation between the receptacle 26 and the rotating post 44. The receptacle 26, tab 35, rotating post 44, and slot 55 are sized according to each other such that the rotating post 44 may not be inserted into the receptacle 26 without the slot 55 also receiving the tab 35. The tab 35 and/or slot 55 may also be tapered for easy assembly and/or alignment (e.g., the slot 55 being wider at its opening, and the tab 35 being narrow toward the opening of the receptacle 26). According to other exemplary embodiments, the receptacle 26 and rotating post 44 may be configured in other manners to prevent misalignment and to prevent relative rotation of the receptacle 26 and the rotating post 44 including, for example, by providing particular shapes (e.g., symmetrical polygonal shapes that prevent relative rotation, irregular polygonal or half moon shapes that ensure proper alignment and prevent relative rotation, etc.), and/or configuring different interfaces (e.g., post or nub with corresponding slot or detent, providing the tab on the rotating post 44 and complementary slot in the receptacle 26).

According to an exemplary embodiment, the receptacle 26 includes an aperture 36 configured to receive a fastener 37 to abut a complementary mating surface 56 of the rotating post 44. The aperture 36 and mating surface 56 are disposed opposite the tab 35 and slot 55 of the receptacle 26 and rotating post 44, respectively. The aperture 36 is configured to receive the fastener 37 (e.g., bolt, screw, set screw, etc.), which engages the mating surface 56 to compress the rotating post 44 against an interior surface of the receptacle 26 and press the slot 55 around and/or against the tab 35. Mating surface 56 may be further configured to provide a rigid coupling with the fastener 37 and may, for example, include a detent, lip, or ridge over which the fastener 37 must pass for removal of the rotating post 44 out of the receptacle 26, and/or a tapered surface to localize pressure of the fastener 37 to plastically and/or elastically deform either or both the fastener 37 and mating surface 56 to provide a rigid couple therebetween. The body 23 of the first arm 20 includes an aperture 38 to provide access to the fastener 37, with the aperture 38 being disposed on a bottom side of the first arm 20 so as not to be seen.

According to an exemplary embodiment, the first arm 20 and rotating mounting bracket 40 are configured to limit rotational movement of the first arm 20 relative to the mounting surface. For example, the first arm 20 and the rotating mounting bracket 40 may limit the first arm 20 to rotate approximately 45 degrees counterclockwise from a closed position to an open position (compare FIG. 1A with FIG. 2). The base post 43 of the rotating mounting bracket 40 may, for example, include a channel, ridge, or shelf 57 running between a first stop 58 and a second stop 59. The first arm 20 includes an extension tab 39, for example, extending from the support 32 for the receptacle 26. When the rotating post 44 is disposed in the receptacle 26, the extension tab 39 is disposed in the channel 57. The extension tab 39 may then run between the first stop 58 and the second stop in the channel 57 and, therefore, limit rotation of the first arm 20 to the angular range defined by the first stop 58, second stop 59, and width of the extension tab 39. According to other exemplary embodiments, the rotation of the first arm 20 may be controlled in other manners including, for example providing no limit, allowing more or less rotating, and/or changing the orientation of extension tab 39 and channel 57 (e.g., providing an extension tab on the base post 43 and a channel and/or stops on the first arm 20 or receptacle 26).

According to an exemplary embodiment, the first arm 20 and the rotating mounting bracket 40 are configured such that the first arm 20 covers the rotating mounting bracket 40 from view. The peripheral edge 25 of the base portion 21 and the body 23 of the first arm 20 are sized and shaped to generally cover the rotating mounting bracket 40. Particularly, the peripheral edge 25 may be sized slightly larger than the base flange 42 of the rotating mounting bracket 40 (e.g., larger by 2 mm). The peripheral edge 25 is also shaped according to, and then aligned with, the rotating mounting bracket 40, such that the base flange 42 of the mounting bracket is generally disposed within the peripheral edge 25 of the first arm 20 when the first arm 20 is rotated between open and closed positions. Further, the peripheral edge 25 may be generally planar to be disposed proximate the mounting surface with a generally constant gap between the peripheral edge 25 and the mounting surface. The body 23 is also sized such that the gap is relatively small between the mounting surface and the peripheral edge 25 (e.g., more or less than approximately 2 mm). According to other exemplary embodiments, the first arm 20 and rotating mounting bracket 40 may be configured in other manners, such as having different shapes, providing a larger or smaller gap between the peripheral edge 25 and the mounting surface, allowing a portion of the rotating bracket 40 to be seen in an open position, etc.

Figure 7A:
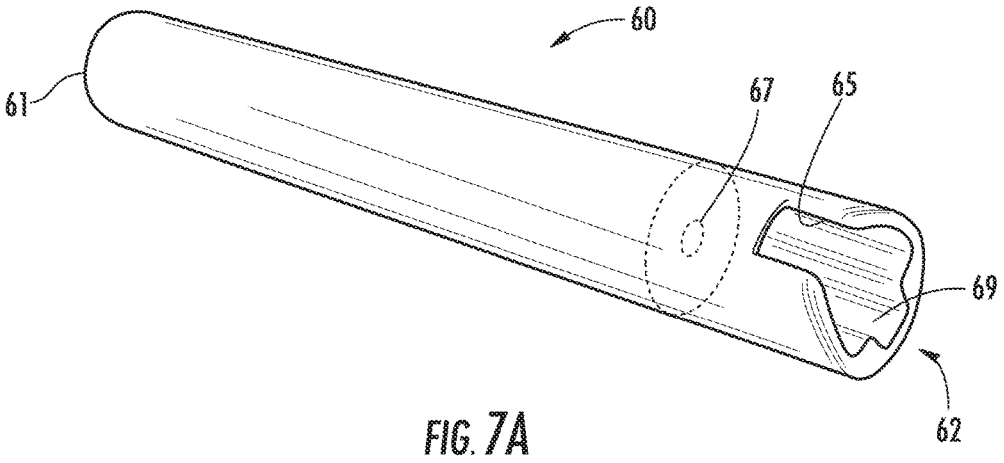
FIG. 7A is a perspective view of an extension member of a paper dispenser according to an exemplary embodiment.
Figure 7B:
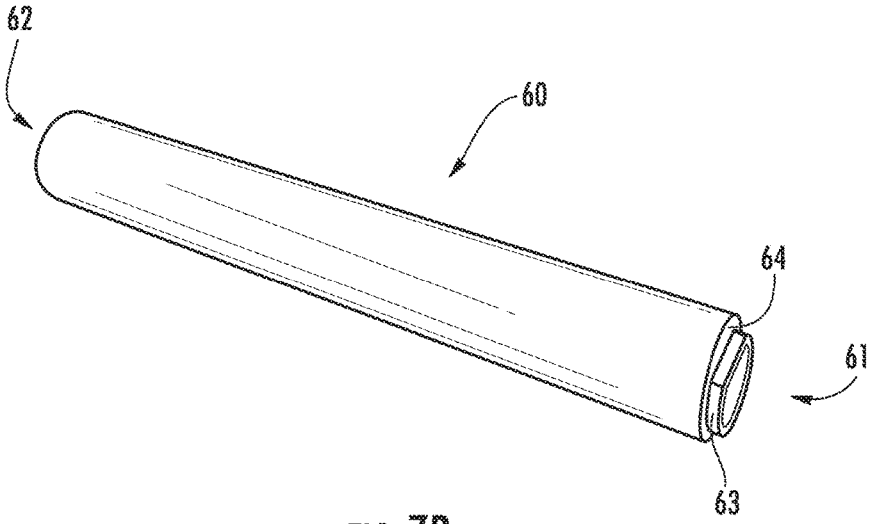
FIG. 7B is a perspective view of the extension member shown in FIG. 7A according to an exemplary embodiment.

Now referring to FIG. 7, the extension member 60 is configured to couple to and extend from the first arm 20 and to releasably engage the second arm 70. The extension member 60 is a generally elongate, hollow member terminating at a first end 61 and a second end 62. The first end is configured to engage the first arm 20 and includes a protrusion 63 and a shoulder 64. The shoulder 64 of the extension member 60 is configured to abut the peripheral edge 28 of the end portion 22 of the first arm 20 (i.e., approximately same outer diameter, thickness, and profile). The protrusion 63 of the extension member 60 is configured to be disposed slightly within the cavity 27 of the end portion 22, so as to maintain alignment of the extension member 60 to the end portion 22 of the first arm 20 (i.e., tight tolerance of less than approximately 0.3 mm). The protrusion 63 may also include a detent that is complementary to an interior profile of the peripheral edge 28, so as to prevent relative rotation between the extension member 60 and the first arm 20. The second end 62 may include an aperture 67 configured to receive and engage the fastener 66, such that the fastener 66 extends through generally the majority of the extension member 60 to couple to the fastening aperture 29 of the first arm 20. According to other exemplary embodiments, the extension member 60 may be integral with the first arm 20 or may be coupled to the first arm 20 in different manners including, for example, disposing the aperture 67 toward the first end 61, press or other interference fit, use of adhesives, etc.

According to an exemplary embodiment, the second end 62 of the extension member 60 is configured to releasably engage a post or extension 85 at an end portion 72 of the second arm 70. The second end 62 generally includes a cutout or mouth 65 and an engaging surface 69. The cutout 65 is configured to have a wider lower portion configured to receive the post 85 of the second arm 70. The engaging surface 69 is configured to releasably engage (i.e., abut) the post 85, so as to prevent further rotation of the first arm 20 and to prevent translational movement or displacement (e.g., horizontal movement) of the extension member 60 relative to the second arm 70. The engaging surface 69 may be shaped in a complementary manner to the post 85, for example, including an upper rounded surface and generally parallel vertical surfaces extending therefrom, the upper rounded surface having a contour generally matching that of the post 85 and the vertical surfaces being spaced about a distance slightly more than the width of post 85. Further, an interior surface of end 62 of the extension member 60 may be contoured so as to guide the post 85 from the cutout 65 to the engaging surface 69. The second end 62 of the extension member 60 may also be shaped, such as with a tapered or rounded side profile, to account for lateral displacement of a bottom edge of the extension member 60 as it rotates so as not to interfere with the end portion 72 of the second arm 70.

Figure 8A:
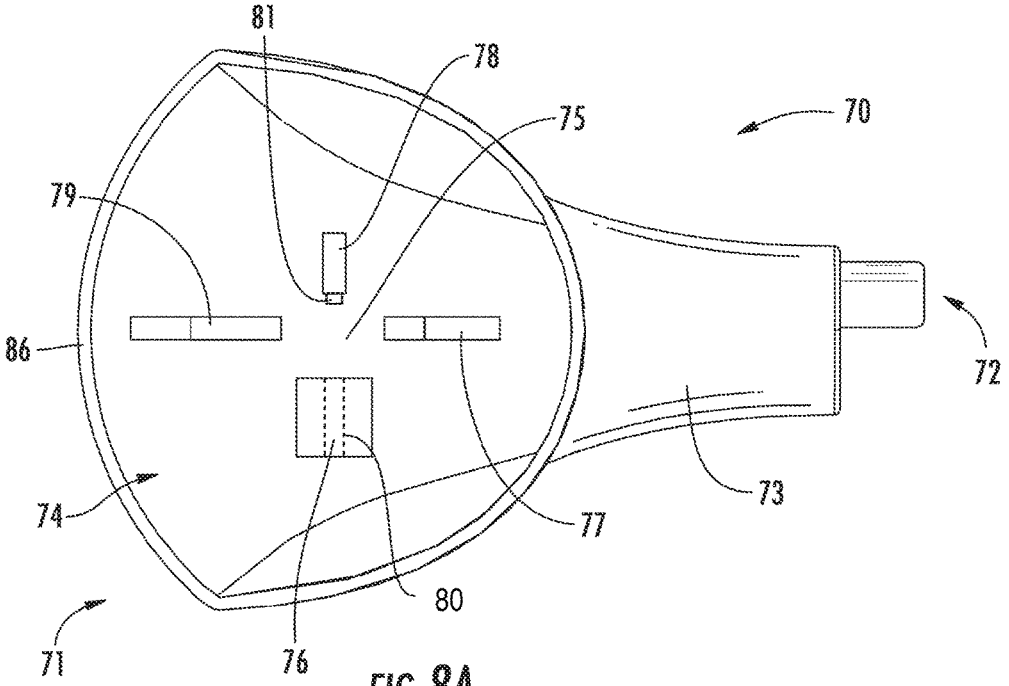
FIG. 8A is a rear view of a second arm of a paper dispenser according to an exemplary embodiment.
Figure 8B:
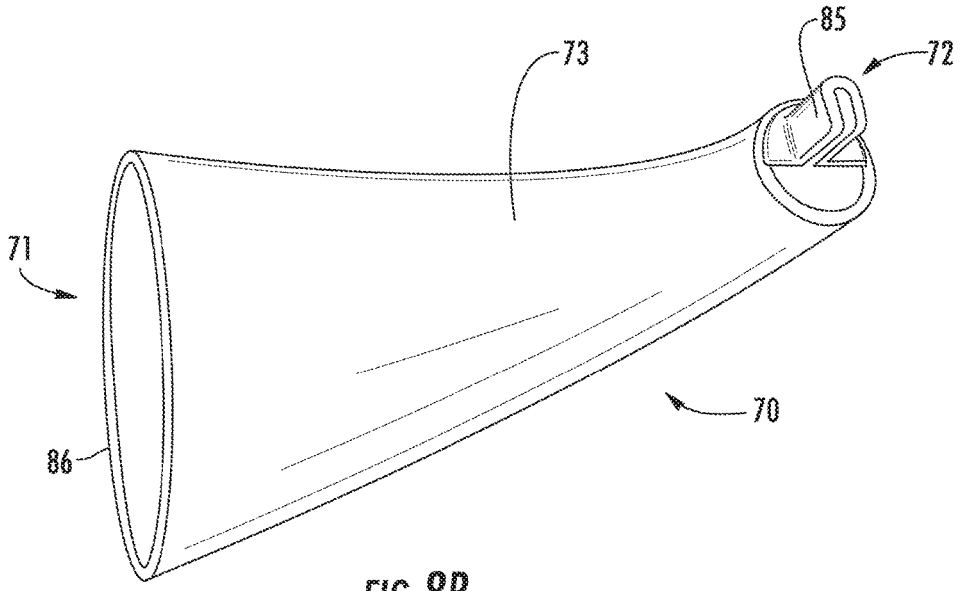
FIG. 8B is a side view of the second arm shown in FIG. 8A according to an exemplary embodiment.

Now referring to FIG. 8A-8B, according to an exemplary embodiment, the second arm 70 generally includes a base portion 71, an end portion 72, and a body 73 extending between the base portion 71 and the end portion 72. The base portion 71 includes a cavity 74 generally defined by a base peripheral edge 86 and an interior surface of the body portion 73. The cavity 74 includes a receptacle 75 integrally or separately formed from the second arm 70. The receptacle 75 is defined by four supports 76, 77, 78, 79, which extend from the interior surface of the cavity 74 to form generally parallel mounting surfaces. As discussed in further detail below, the second arm 70 is configured to rigidly couple to the mounting surface by way of the stationary mounting bracket 90. Various features of the second arm 70 and receptacle 75 are discussed in conjunction with the stationary mounting bracket 90 below.

Referring again to FIG. 3B, according to an exemplary embodiment, the stationary mounting bracket 90 generally includes a mounting flange 91 and a mounting post 92 extending generally perpendicular from the mounting flange 91. The mounting flange 91 includes one or more apertures 93 configured to receive fasteners (e.g., screws, bolts, clips, pins, etc.) to rigidly couple the stationary mounting bracket 90 to the mounting surface.

According to an exemplary embodiment, the stationary mounting bracket 90 is configured to rigidly couple to the second arm 70 so as to mount the second arm 70 to the mounting surface. Similar to the receptacle 26 of the first arm 20 and the rotating post 44 of the rotating mounting bracket 40, the receptacle 75 of the second arm 70 and the mounting post 92 of the stationary mounting bracket 90 include complementary features for a rigid coupling.

According to an exemplary embodiment, supports 76, 78, respectively, provide a tab 81 opposite an aperture 80. The aperture 80 is complementary to a mounting surface 94 of the mounting post 92 of the stationary mounting bracket 90, the aperture 80 configured to receive a fastener 95, such as a set screw. The body 73 of the second arm 70 includes an aperture 88 to provide access to the fastener 95 and is disposed on a bottom side of the second arm 70 so as to be hidden from view. The mounting surface 94 may include a detent and/or a tapered surface, similar to the rotating post 44, configured to receive and rigidly couple to the fastener 95. The tab 81 is complementary to a slot 96 of the mounting post 92. The tab 81 and slot 96 are configured to ensure proper alignment and prevent relative rotation of the second arm 70 and the stationary mounting bracket 70 and may include similar features to the tab 35 and slot 55 of the first arm 20 and rotating post 44, such as relative size, shape, and taper, to rigidly couple the second arm 70 to the stationary mounting bracket 90.

According to an exemplary embodiment, the dispenser 10 is mounted to a mounting surface, such as a wall or other generally planar surface. The rotating and stationary mounting brackets 40, 90 are coupled to the mounting surface, such as with wood screws, bolts, or other fasteners. The brackets 40, 90 disposed at generally the same vertical position and are spaced apart a distance to allow a small gap between the second end 62 of the extension member 60 and the end portion 72 of the second arm 70, while still allowing the second end 62 to engage the post 85. The first arm 20 is then coupled to the rotating mounting bracket 40, the receptacle 26 receiving the rotating post 44 and the fastener 37 turned via a tool extending through aperture 38, such that the fastener 37 rigidly engages the rotating post 44. The second arm 70 is similarly coupled to the stationary mounting bracket 90, the receptacle 75 receiving the mounting post 92 and the fastener 95 turned via a tool extending through aperture 88, such that the fastener 95 rigidly engages the mounting post 92.

According to an exemplary embodiment, after mounting the dispenser 10 to a mounting surface, the dispenser 10 may then be operated. From a closed position, the dispenser 10 may be configured into an open position by applying a generally perpendicular force against the extension member 60 and in parallel with the mounting surface so as to rotate the first arm 20 about the rotating mounting bracket 40. While in the open position, a roll of product may be placed on the extension member 60 and/or an empty roll may be removed from the extension member 60. From the open position, the dispenser 10 may be configured into a closed position by applying a generally perpendicular force against the extension member 60 in parallel with the mounting surface so as to rotate the first arm 20 about the rotating mounting bracket 40 until the extension member 60 engages the post 85 of the second arm 70. Product may then be dispensed by a user pulling on an end of the rolled product so as to unroll and reveal additional product, or by any other manner suitable for removing product from the roll.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of components as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A rolled paper dispenser, comprising:

a first arm having a cavity;

a second arm spaced apart from the first arm, the second arm including one of an extension and a cutout; and an elongated paper holder extending between a first end, which is coupled to the first arm, and a second end, which has the other of the extension and the cutout to couple to the second arm in a closed position and to decouple from the second arm in an open position, the paper holder comprising a tubular member and a fastener, the tubular member having an outer surface, which is configured to receive a rolled paper product, and an inner surface, which defines a longitudinal bore in which the fastener is disposed, the fastener extending beyond the tubular member at the first end to engage the cavity to couple the paper holder to the first arm;

wherein the cutout extends radially away from the tubular member in the closed position through a side of the second arm.

2. The rolled paper dispenser of claim 1, wherein the fastener engages an inner portion of the cavity and an end of the tubular member engages an outer portion of the cavity.

3. The rolled paper dispenser of claim 2, wherein the cavity is stepped such that a size of an opening of the inner portion of the cavity is smaller than a size of an opening of the outer portion of the cavity.

4. The rolled paper dispenser of claim 2, wherein an end of the tubular member engaging the first arm includes a protrusion extending from a shoulder, wherein the shoulder abuts a peripheral edge of the first arm, and the protrusion extends into the outer portion of the cavity.

5. The rolled paper dispenser of claim 1, further comprising:

a first mounting bracket configured to mount to a wall at a first location; and a second mounting bracket configured to mount to the wall at a second location;

wherein the first arm detachably couples to the first mounting bracket, and the second arm detachably couples to the second mounting bracket.

6. The rolled paper dispenser of claim 5, wherein the first arm comprises:

a base portion having a bore, which receives the first mounting bracket, and a receptacle, which receives a portion of the first mount bracket to couple the first arm and the first mounting bracket together;

an end portion having an end surface that is transversely aligned relative to the first mounting bracket, the end portion having the cavity in the end surface; and a body portion interconnecting the base and end portions together.

7. The rolled paper dispenser of claim 6, wherein the second arm comprises:

a base portion having a bore, which receives the second mounting bracket, and a receptacle, which receives a portion of the second mount bracket to couple the second arm and the second mounting bracket together;

an end portion having an end surface that is transversely aligned relative to the second mounting bracket, the end portion including the extension extending from the end surface or the cutout in the end surface; and a body portion interconnecting the base and end portions together.

8. The rolled paper dispenser of claim 5, further comprising:

a rotating bushing located within the first arm and fixedly coupled to part of the first arm; and a fixed bushing located within the first arm;

wherein the rotating bushing, the part of the first arm, and the elongated paper holder rotate relative to the fixed bushing.

9. The rolled paper dispenser of claim 8, wherein a surface of the rotating bushing rotates against a surface of the fixed bushing during rotation of the elongated paper holder.

10. The rolled paper dispenser of claim 5, wherein the first mounting bracket includes a base post extending upwardly from a base flange, wherein the rolled paper dispenser further comprises a rotating post that rotates against a surface of the base post, and wherein the rotating post includes a slot that receives a tab of the first arm to couple the rotating post and first arm together rotationally.

11. The rolled paper dispenser of claim 10, wherein the fixed post includes a semi-annular channel defining a first stop and a second stop, wherein the first arm includes an extension that rides in the channel and has an angular rotation that is limited by the first and second stops, which limits rotation of the elongated paper holder.

12. An elongated paper holder comprising:

an extension member comprising:

a cylindrical body extending along a longitudinal axis between a first end and a second end, wherein the body has an outer surface that receives a rolled paper product, and wherein the first end is configured to be received in a bore in a first arm;

a bore extending through the body along the longitudinal axis; and a cutout extending radially away from the longitudinal axis through a side of the body at the second end into the bore of the body, wherein the cutout is configured to receive a post from a second arm;

a fastener extending through the bore and beyond the first end, wherein the fastener is configured to engage the first arm to couple the paper holder to the first arm.

13. The paper holder of claim 12, wherein the cutout is rectangular in shape, and wherein the second end is open.

14. A rolled paper dispenser comprising the paper holder of claim 12, wherein the rolled paper dispenser comprises the first arm and the second arm, wherein the first arm is rotatable relative to the second arm, and wherein the fastener engages the bore in the first arm so that the paper holder rotates with the first arm relative to the second arm.

15. The rolled paper dispenser of claim 14, wherein the first arm comprises:

a base portion that is mountable to a wall through a mounting bracket; and an end portion that rotates with the paper holder relative to the mounting bracket through a bushing.

16. The paper holder of claim 12, wherein the extension member further comprises a protrusion extending away from the body at the first end.

17. A rolled paper dispenser comprising the paper holder of claim 16, wherein the rolled paper dispenser comprises the first arm and the second arm, wherein the first arm is rotatable relative to the second arm, and wherein the protrusion engages a first part of the bore in the first arm and the fastener engages a second part of the bore in the first arm so that the paper holder rotates with the first arm relative to the second arm.

18. The rolled paper dispenser of claim 17, wherein the first arm comprises:

a base portion that is mountable to a wall through a mounting bracket; and an end portion that rotates with the paper holder relative to the mounting bracket through a bushing.

19. The rolled paper dispenser of claim 18, wherein the mounting bracket includes a base post extending upwardly from a base flange, wherein a rotating post disposed within the first arm rotates against a surface of the base post, and wherein the rotating post includes a slot that receives a tab of the first arm to couple the rotating post and first arm together rotationally.

20. The rolled paper dispenser of claim 18, wherein a rotating bushing is located within the first arm and fixedly coupled to part of the first arm, wherein a fixed bushing is located within the first arm, and wherein the rotating bushing, the part of the first arm, and the elongated paper holder rotate relative to the fixed bushing.

* * * * *